US010697249B2

(12) United States Patent
Madrid et al.

(10) Patent No.: US 10,697,249 B2
(45) Date of Patent: Jun. 30, 2020

(54) METHOD AND ASSEMBLY FOR DOWNHOLE DEPLOYMENT OF WELL EQUIPMENT

(71) Applicant: SALAMANDER SOLUTIONS INC., Houston, TX (US)

(72) Inventors: Reydesel Galindo Madrid, Angleton, TX (US); David Booth Burns, Houston, TX (US); Robert Guy Harley, Spring, TX (US); Edward Everett De St. Remey, Sugar Land, TX (US); Jay Wasson Roff, Campo Macco (VE); Ovidio Anto Salazar Deloino, San Mateo (VE)

(73) Assignee: Salamander Solutions Inc., Houston, TX (US)

( * ) Notice: Subject to any disclaimer, the term of this patent is extended or adjusted under 35 U.S.C. 154(b) by 0 days.

(21) Appl. No.: 16/501,753

(22) Filed: Jun. 3, 2019

(65) Prior Publication Data

US 2020/0040666 A1 Feb. 6, 2020

Related U.S. Application Data

(63) Continuation-in-part of application No. PCT/US2017/065168, filed on Dec. 7, 2017.

(60) Provisional application No. 62/433,059, filed on Dec. 12, 2016.

(51) Int. Cl.
*E21B 17/02* (2006.01)
*E21B 33/04* (2006.01)

(52) U.S. Cl.
CPC ..... *E21B 17/028* (2013.01); *E21B 33/04* (2013.01)

(58) Field of Classification Search
CPC ..... E21B 33/04; E21B 33/047; E21B 17/028
See application file for complete search history.

(56) References Cited

U.S. PATENT DOCUMENTS

| | | | |
|---|---|---|---|
| 2,634,961 | A | 4/1953 | Ljungstrom |
| 2,732,195 | A | 1/1954 | Ljungstrom |
| 2,780,450 | A | 2/1957 | Ljungstrom |
| 2,789,805 | A | 4/1957 | Ljungstrom |
| 2,923,535 | A | 2/1960 | Ljungstrom |
| 4,200,297 | A | 4/1980 | Tricon |
| 4,886,118 | A | 12/1989 | Van Meurs et al. |
| 6,360,819 | B1 | 3/2002 | Vinegar |
| 6,688,387 | B1 | 2/2004 | Wellington et al. |

(Continued)

*Primary Examiner* — Kristyn A Hall

(57) ABSTRACT

An assembly for downhole deployment of well equipment, the assembly being above a coiled tubing which receives a part of a cable assembly and below a production pump, the assembly including: a split hanger fixing the cable assembly coming out of the coiled tubing; a seal connectable to the split hanger, configured to prevent formation fluid from entering the coiled tubing. The set of connectors includes: a coiled tubing connector, configured to connect the assembly to the coiled tubing; a lower connector, an upper part of the lower connector being adapted to receive, at least in part, the split hanger and the seal; an upper connector arranged above the lower connector; an adjusting nut; the upper connector and the adjusting nut being connectable to each other, thereby fixing the assembly relative to the coiled tubing; a lower part of the upper connector having an exit enabling the cable assembly to extend out of the assembly.

10 Claims, 14 Drawing Sheets

(56) References Cited

U.S. PATENT DOCUMENTS

| | | | |
|---|---|---|---|
| 7,891,416 | B2 | 2/2011 | Pankratz et al. |
| 2007/0046115 | A1 | 1/2007 | Tetziaff et al. |
| 2014/0099084 | A1 | 4/2014 | Paeman et al. |
| 2015/0354302 | A1 | 10/2015 | Watt et al. |
| 2018/0148990 | A1* | 5/2018 | Wright ..... E21B 33/0415 |

* cited by examiner

METHOD AND ASSEMBLY FOR DOWNHOLE DEPLOYMENT OF WELL EQUIPMENT

RELATED APPLICATIONS

This application is a continuation in part of PCT/US17/65168 which claims priority to U.S. 62/433,059.

FIELD OF THE INVENTION

The present disclosure relates to in situ hydrocarbon recovery operations and apparatuses, and more particularly, to a method and apparatus for downhole deployment of well equipment such as heaters and instrumentation for in situ hydrocarbon recovery.

BACKGROUND TO THE INVENTION

Hydrocarbons obtained from subterranean formations are often used as energy resources, as feedstocks, and as consumer products. Concerns over depletion of available hydrocarbon resources and concerns over declining overall quality of produced hydrocarbons have led to development of processes for more efficient recovery, processing and/or use of available hydrocarbon resources. In situ processes may be used to extract hydrocarbon materials from subterranean formations that were previously inaccessible and/or too expensive to extract using available methods. Chemical and/or physical properties of hydrocarbon material in a subterranean formation may need to be changed to allow hydrocarbon material to be more easily removed from the subterranean formation and/or increase the value of the hydrocarbon material. The chemical and physical changes may include in situ reactions that produce removable fluids, composition changes, solubility changes, density changes, phase changes, and/or viscosity changes of the hydrocarbon material in the formation.

Heaters may be placed in wellbores to heat a formation during an in situ process. Examples of in situ processes utilizing downhole heaters are illustrated in U.S. Pat. No. 2,634,961 to Ljungstrom; U.S. Pat. No. 2,732,195 to Ljungstrom; U.S. Pat. No. 2,780,450 to Ljungstrom; U.S. Pat. No. 2,789,805 to Ljungstrom; U.S. Pat. No. 2,923,535 to Ljungstrom; U.S. Pat. No. 4,886,118 to Van Meurs et al.; and U.S. Pat. No. 6,688,387 to Wellington et al., each of which is incorporated by reference as if fully set forth herein. There are many different types of heaters which may be used to heat the formation; a typical type of such heaters can be formed by inserting mineral insulated (MI) cables into coiled tubing.

Currently, various challenges still exist in the area of techniques for downhole deployment of well instrumentation in in situ hydrocarbon recovery operations. For instance, it is a very time consuming and complicated process to deploy heaters in presence of a production pump. US patent application publication No. 20150354302A1 discusses a transition device for deploying instrumentation below a downhole tool, wherein it is proposed to take an instrument line and cross over a portion to the outside an a reverse direction for communication with the reservoir past the pump which could stay in place when the pump is removed. However, the disclosed device is not making the deployment faster, and if the heater is made by inserting MI cables inside coiled tubing, the device cannot prevent formation fluid from entering the coiled tubing, which might lead to serious consequences in high temperature conditions.

SUMMARY OF THE INVENTION

Therefore, it might be advantageous to provide an assembly and method which can achieve one or more of the followings: 1) restricting movement of MI cables due to thermal expansion and/or contraction; 2) providing necessary crossover from the coiled tubing to the production tubing and allowing the coiled tubing to be attached to the production tubing below the intake of the pump; 3) enabling the MI cables and instrument strings get out of the coiled tubing to run around the pump and get strapped onto the exterior of the production tubing for the remaining distance from the downhole location to the wellhead at the ground surface; 4) preventing formation fluids from entering the coiled tubing; 5) allowing for a faster deployment and reducing the risk of getting hung up (because there is a smooth surface in the lateral that does not have cables and clamps or bands strapped to it trying to be deployed).

According to an aspect of the present invention, there is provided an assembly for downhole deployment of well equipment, the assembly being above a coiled tubing which receives a part of a cable assembly and below a production tubing, the assembly comprising: a split hanger fixing the cable assembly outside the coiled tubing; a seal connectable to the split hanger, configured to prevent formation fluid from entering the coiled tubing; a set of connectors, configured to connect the assembly to the coiled tubing. The set of connectors comprises: a coiled tubing connector, configured to connect the assembly to the coiled tubing; a lower connector, an upper part of the lower connector being adapted to receive, at least in part, the split hanger and the seal: an upper connector arranged above the lower connector, and an adjusting nut; the upper connector and the adjusting nut being connectable to each other, thereby fixing the assembly relative to the coiled tubing; a lower part of the upper connector having an exit enabling the cable assembly to extend out of the assembly.

Optionally, the adjusting nut has a flange extruding radially inward and the lower connector has a flange extruding radially outward.

Optionally, the assembly further comprising an end cap, which is connectable to the split hanger via the seal.

According to another aspect of the present invention, there is provided a method for downhole deployment of well instrumentation, comprising: providing an assembly being above a coiled tubing which receives a part of a cable assembly and below a production tubing, the assembly comprising: a split hanger fixing the cable assembly outside the coiled tubing; a seal connectable to the split hanger, configured to prevent formation fluid from entering the coiled tubing; a set of connectors, configured to connect the assembly to the coiled tubing; the set of connectors comprising: a coiled tubing connector, configured to connect the assembly to the coiled tubing; a lower connector, an upper part of the lower connector being adapted to receive, at least in part, the split hanger and the seal; an upper connector arranged above the lower connector, and an adjusting nut; the upper connector and the adjusting nut being connectable to each other, thereby fixing the assembly relative to the coiled tubing; a lower part of the upper connector having an exit enabling the cable assembly to extend out of the assembly.

Optionally, the adjusting nut has a flange extruding radially inward and the lower connector has a flange extruding radially outward.

Optionally, the assembly further comprising an end cap, which is connectable to the split hanger via the seal.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION OF THE INVENTION

Figure 1:
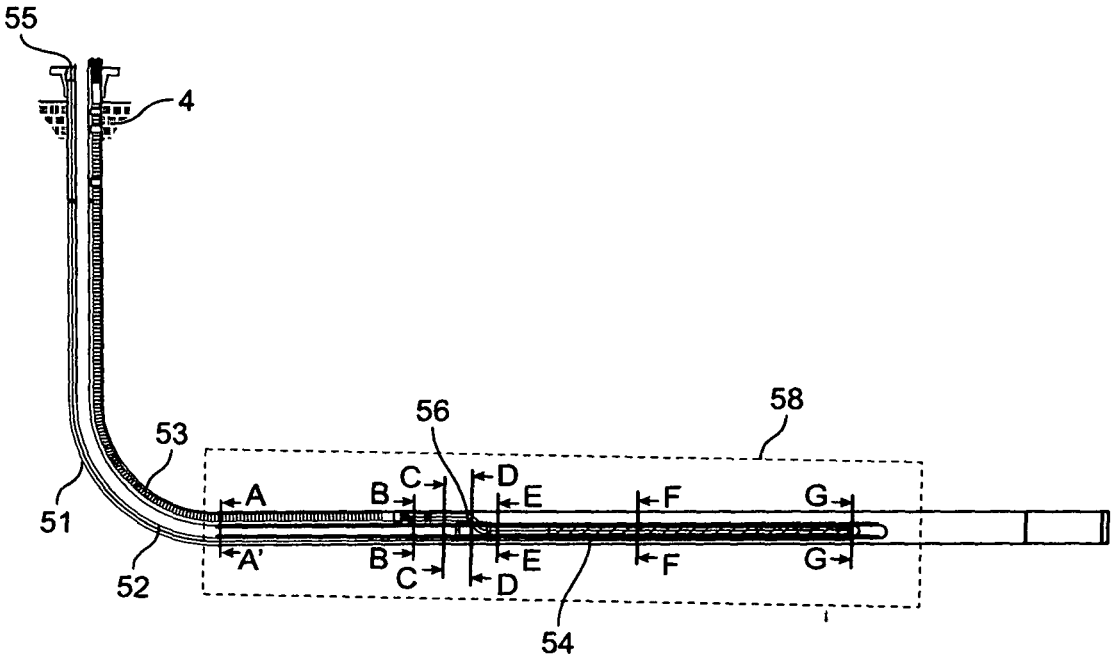
FIG. 1 is an illustration of a wellbore instrumentation deployed using the assembly and method according to an embodiment of the present invention.

While the invention is susceptible to various modifications and alternative forms, specific embodiments thereof are shown by way of example in the drawings and will herein be described in detail. The drawings may not be to scale. It should be understood that the drawings and detailed description thereto are not intended to limit the invention to the particular form disclosed, but to the contrary, the intention is to cover all modifications, equivalents and alternatives falling within the spirit and scope of the present invention as defined by the appended claims.

Below is a table listing the reference numerals for the elements.

| | |
|---|---|
| 20a, 20b, 20 | MI cable(s) |
| 22 | instrument strings |
| 222 | clamps or bands |
| 3 | assembly |
| 30 | (rubber) seal |
| 302 | through holes on the seal (for MI cables) |
| 31 | (split) hanger |
| 31a | a first part of the hanger |
| 31b | a second part of the hanger |
| 32 | lower connector |
| 33 | allen screws (for the hanger) |
| 34 | adjusting nut |
| 35 | end cap |
| 35a | a first part of the end cap |
| 35b | a second part of the end cap |
| 352 | recess on the end cap (for receiving the MI cables) |
| 36 | coiled tubing connector |
| 37 | allen screws (for serially coupling the end cap, the seal and the |
| 38 | upper connector |
| 382 | upper connector lower end |
| 4 | ground surface |
| 40 | end termination (of the coiled tubing) |
| 51 | casing |
| 52 | production tubing |
| 53 | conduit extending from the downhole location to a wellhead |
| 54 | coiled tubing |
| 55 | tube |

-continued

Figure 2:
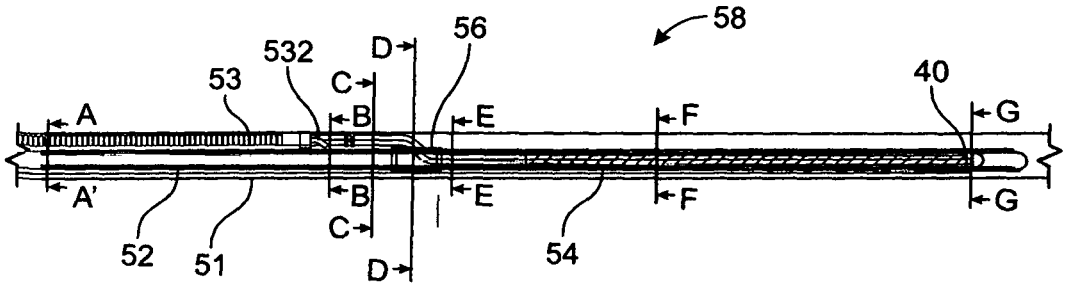
FIG. 2 is an enlarged view of section 58 of the wellbore instrumentation in FIG. 1.

| | |
|---|---|
| 552 | signal carrier |
| 56 | a portion of the system where the proposed assembly is located |
| 58 | a portion of the system an enlarged view of which is shown in FIG. 2 |
| 60 | power lead-in |
| 61 | connector |
| 62 | power lead splice |

Certain terms used herein are defined as follows.

An "artificial lift" refers to the use of artificial means to increase the flow of liquids, such as crude oil or water, from a production well. Generally this is achieved by the use of a mechanical device inside the well (known as pump or velocity string) or by decreasing the weight of the hydrostatic column by injecting gas into the liquid some distance down the well. Artificial lift is needed in wells when there is insufficient pressure in the reservoir to lift the produced fluids to the surface, but often used in naturally flowing wells (which do not technically need it) to increase the flow rate above what would flow naturally. The produced fluid can be oil, water or a mix of oil and water, typically mixed with some amount of gas.

"Coupled"/"connected" means either a direct connection or an indirect connection (for example, one or more intervening connections) between one or more objects or components.

The phrase "directly connected" means a direct connection between objects or components such that the objects or components are connected directly to each other so that the objects or components operate in a "point of use" manner.

A "formation" includes one or more hydrocarbon containing layers, one or more non-hydrocarbon layers, an overburden, and/or an underburden.

"Hydrocarbon layers" refer to layers in the formation that contain hydrocarbons. The hydrocarbon layers may contain non-hydrocarbon material and hydrocarbon material.

The "overburden" and/or the "underburden" include one or more different types of impermeable materials. For example, the overburden and/or underburden may include rock, shale, mudstone, or wet/tight carbonate. In some embodiments of in situ heat treatment processes, the overburden and/or the underburden may include a hydrocarbon containing layer or hydrocarbon containing layers that are relatively impermeable and are not subjected to temperatures during in situ heat treatment processing that result in significant characteristic changes of the hydrocarbon containing layers of the overburden and/or the underburden. For example, the underburden may contain shale or mudstone, but the underburden is not allowed to heat to pyrolysis temperatures during the in situ heat treatment process. In some cases, the overburden and/or the underburden may be somewhat permeable.

"Formation fluids" refer to fluids present in a formation and may include pyrolyzation fluid, synthesis gas, mobilized hydrocarbons, and water (steam). Formation fluids may include hydrocarbon fluids as well as non-hydrocarbon fluids.

The term "mobilized fluid" refers to fluids in a hydrocarbon containing formation that are able to flow as a result of thermal treatment of the formation. "Produced fluids" refer to fluids removed from the formation.

A "heater"/"heat source" is a system for providing heat to at least a portion of a formation substantially by conductive heat transfer. For example, a heater may include electrically conducting materials and/or electric heaters such as an insulated conductor, an elongated member, and/or a conductor disposed in a conduit.

"Hydrocarbons" are generally defined as molecules formed primarily by carbon and hydrogen atoms. Hydrocarbons may also include other elements such as, but not limited to, halogens, metallic elements, nitrogen, oxygen, and/or sulfur. Hydrocarbons may be, but are not limited to, kerogen, bitumen, pyrobitumen, oils, natural mineral waxes, and asphaltites. Hydrocarbons may be located in or adjacent to mineral matrices in the earth. Matrices may include, but are not limited to, sedimentary rock, sands, silicilytes, carbonates, diatomite, and other porous media.

"Hydrocarbon fluids" are fluids that include hydrocarbons. Hydrocarbon fluids may include, entrain, or be entrained in non-hydrocarbon fluids such as hydrogen, nitrogen, carbon monoxide, carbon dioxide, hydrogen sulfide, water, and ammonia.

An "in situ conversion process" refers to a process of heating a hydrocarbon containing formation from heat sources to raise the temperature of at least a portion of the formation above a pyrolysis temperature so that pyrolyzation fluid is produced in the formation.

An "in situ heat treatment process" refers to a process of heating a hydrocarbon containing formation with heat sources to raise the temperature of at least a portion of the formation above a temperature that results in mobilized fluid, visbreaking, and/or pyrolysis of hydrocarbon containing material so that mobilized fluids, visbroken fluids, and/or pyrolyzation fluids are produced in the formation.

"Instrument strings" refer to any elongated cables, lines deployed in downhole in addition to MI cables, with or without attachment (e.g. sensors). Instrument strings might include but are not limited to any of the following: fibre optic cable, sensor cable, thermocouple cable.

"Insulated conductor" refers to any elongated material that is able to conduct electricity and that is covered, in whole or in part, by an electrically insulating material.

The term "wellbore" refers to a hole in a formation made by drilling or insertion of a conduit into the formation. A wellbore may have a substantially circular cross section, or another cross-sectional shape.

The term "wellbore equipment" refers to equipment to be installed in a wellbore such as, but not limited to, heaters, heat sources, or submersible pumps.

As used herein, the terms "well" and "opening," when referring to an opening in the formation may be used interchangeably with the term "wellbore." A wellbore may be substantially vertical, like "I", or include a substantially vertical part and a substantially horizontal part, like "L".

Throughout the present specification, unless specified differently, the terms "above", "upper", "upward", "upstream" and similar terms refer to a direction closer to the head of a wellbore or the ground surface, while the teams "ahead", "below", "forward", "downward", "lower", "downstream" and similar terms refer to a direction closer to a bottom/end of a wellbore. Additionally, the team "proximal" refers to a location, an element, or a portion of an element that is further above with respect to another location, element, or portion of the element, while the term "distal" refers to a location, an element, or a portion of an element, that is further below of another location, element, or portion of the element.

FIG. 1 is an illustration of wellbore equipment using the assembly and method according to certain embodiments of the present invention. In FIG. 1, a wellbore extends from the ground surface 4 downwards, forming a substantially vertical part, and then a substantially horizontal part, so is in general a "L"-shape wellbore. In an example, heating by heaters is performed in the horizontal part.

In the wellbore, it can be seen that a casing 51 is provided to receive the coiled tube 54, an artificial lift (e.g. an electrical submerged pump, not shown), the production tubing 52, etc. The coil tubing 54 extends downstream the production tubing 52, the crossover therebetween is done in section 56, which will be further described in details below. Sectional views, A-A through G-G, of different parts of the instrumentation are illustrated in FIGS. 12*a*-12*g*, respectively, which will also provide more details of the embodiments of the present invention. A portion of the system, 58, shown in FIG. 2 in a larger view. A conduit extending from the downhole location to a wellhead, 53, is shown as a path for, for example, electrical power supplies to a heater located in the coiled tubing, 54, or a electrical submerssable pump ("ESP"). A tube 55 could extend to the surface suitable for protecting wires, such as thermocouple wires, and/or fiberoptic cables for communication with downhole equipment. Tube 55 may be beneficial when the equipment requires or could utilize, for example, wires or fiber optic cables for communications where the wires or fiber optic cables could be damaged by the process of inserting the equipment into the wellbore or by the environment within the wellbore. Communication could also be provided via power supplies by imposing high frequency signals onto the power supply by modems located, for example, at the surface and downhole. In other embodiments of the present invention, wires, such as thermocouple wires and/or fiberoptic cables could be provided without the tube 55 for protection.

To run a heater downstream of pump, according to certain embodiments of the invention, MI cables and instrument strings are assembled inside coiled tubing 54 which is then installed into the wellbore (ahead of the pump and the production tubing 52). Using coiled tubing for at least a portion of the downhole equipment could allow for a faster deployment and could reduce the risk of the downhole equipment becoming hung up, because there is a smooth surface in the lateral that does not have cables and clamps or bands strapped to it trying to be deployed. The coiled tubing is e.g. the type described in U.S. Pat. No. 6,015,015.

FIG. 2 illustrates an enlarged view of section 58 of the apparatus shown in FIG. 1. Components are labeled as shown in FIG. 1. A transition/crossover between the coiled tubing 54 and the production tubing 52 happens in section 56. End termination of the coiled tubing 40, caps and seals the coiled tubing. The coiled tubing 54 is provided in which MI cables and instrument strings are installed, for example, to heat the formation around the wellbore. A transition section 56 from coiled tubing 54 to production tubing 52 is shown where, with the aid of an assembly as proposed in this present invention, MI cables and/or instrument strings are taken out of the coiled tubing 54 and strapped to an exterior surface of the production tubing 52 for the remaining distance from the downhole location (e.g. roughly from section 56 and along conduit extending from the downhole location to a wellhead 53) to the wellhead at the ground surface 4.

Figure 3:
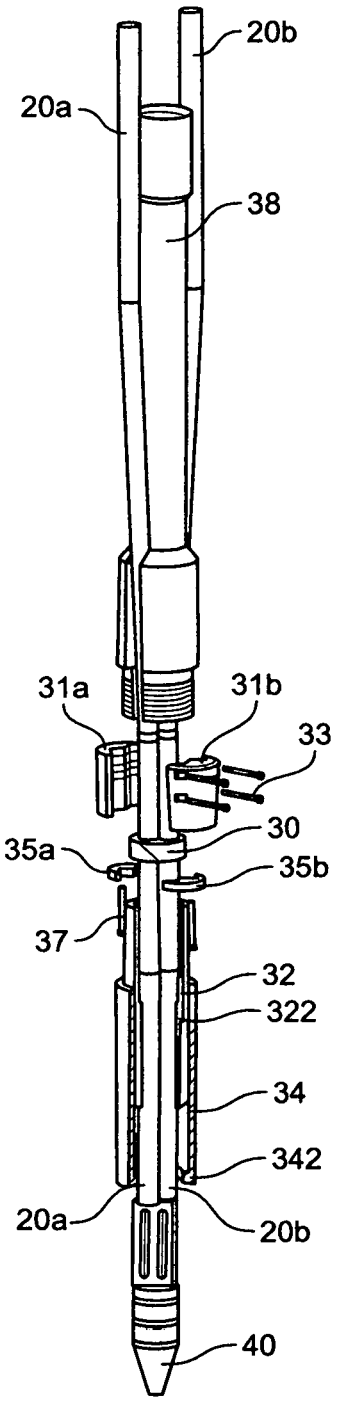
FIG. 3 is an explosive view showing the assembly for downhole deployment of well instrumentation according to an embodiment of the present invention.

FIG. 3 is a partial cross section and exploded view showing the assembly for downhole deployment of well equipment according to an embodiment of the present invention. An end termination, 40, is shown to seal the end, and enable the coiled tubing to be pushed through the casing from the surface wellhead. The end termination may provide for electrical connections between the terminal ends of different MI heaters. Two mineral insulated cable heaters 20*a* and 20*b* are shown in a cross section portion of the coiled tubing. A fixing nut 34 can have a flange 342 extruding radially inward, and the lower connector 32 can have a flange 322 extruding radially outward, thereby fix the whole set. An upper connector 38 provides a connection to the production tubing, and paths for, for example, MI cables 20*a* and 20*b*, to pass from inside the coiled tubing (not shown) to outside of the production tubing (not shown). A hanger 31 is shown in two parts 31*a* and 31*b*, connected to the upper connector and the MI cables, held together by allen screws 33. Of course a person of ordinary skill in the art could replace the allen screws with different types of fasteners. A seal 30, preferably made of a elastomeric material is provided to prevent formation fluids from entering the coiled tubing from between the upper connector and the lower connector. The seal, sometimes referred to as a rubber seal 30, is pressed into place by end cap 35, shown as two parts, end cap first part 35*a* and end cap second part 35*b*. The end cap may be connected to the hanger by screws such as allen screws 37 that extend through the end cap 35 and into the hanger 31.

Referring to FIG. 3, the fixing nut 34 can have a flange 342 extruding radially inward, and the lower connector can have a flange 322 extruding radially outward, thereby fix the whole set.

Figure 4:
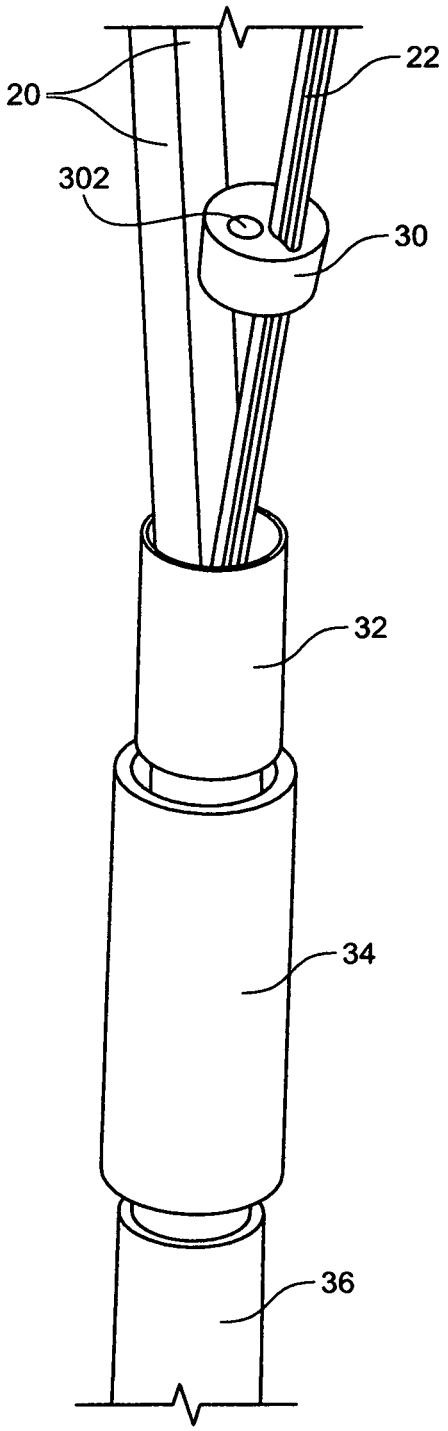
FIGS. 4-11 illustrate a process of installing the assembly according to certain embodiments of the present invention.

FIG. 4 show more detail of an embodiment of the invention with the set of connectors comprising a coiled tubing connector 36 attached to the lower connector 32 by the adjusting nut 34. MI cables 20*a* and 20*b* are shown extending from the lower connector along with instrument string 22. Seal 30 is shown with three holes for passage of the two MI cables and the instrument string. The lower connector includes an upper part of the lower connector suitable for receiving a split hanger and a seal.

In the deployment, a lower part of MI cables 20*a* and 20*b*, a lower part of instrument strings 22 are inserted inside coiled tubing, which is then installed inside the wellbore, ahead of e.g. the pump, the production tubing 52. After then, referring to FIG. 4, at the ground surface or near the wellhead, a coiled tubing connector 36 is connected to and above the coiled tubing 54 (not shown). The coiled tubing connector 36 allows the engineers to install the proposed assembly 3. A lower connector 32 is connected to and above the coiled tubing connector 36, with an adjusting nut 34 preferably in between. In this example, the connectors are substantially cylindrical, and the exposed MI cables 20 and the instrument strings 22 can pass through.

A rubber seal 30 is provided, having through holes sized according to diameter of the MI cables 20 and the instrument strings 22. In FIG. 4, it can be seen that instrument strings 22 are inserted through the seal 30. In an example, the instrument strings 22 include fiber optic cable, sensor cable and thermocouple cables. In this step, a screw driver might be useful.

Figure 5:
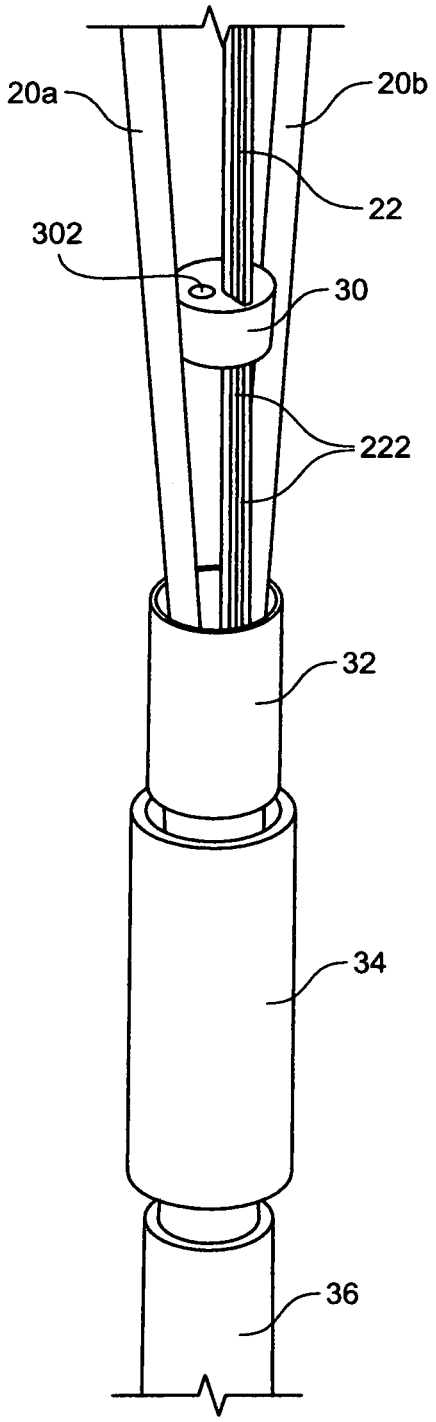
Figure 6:
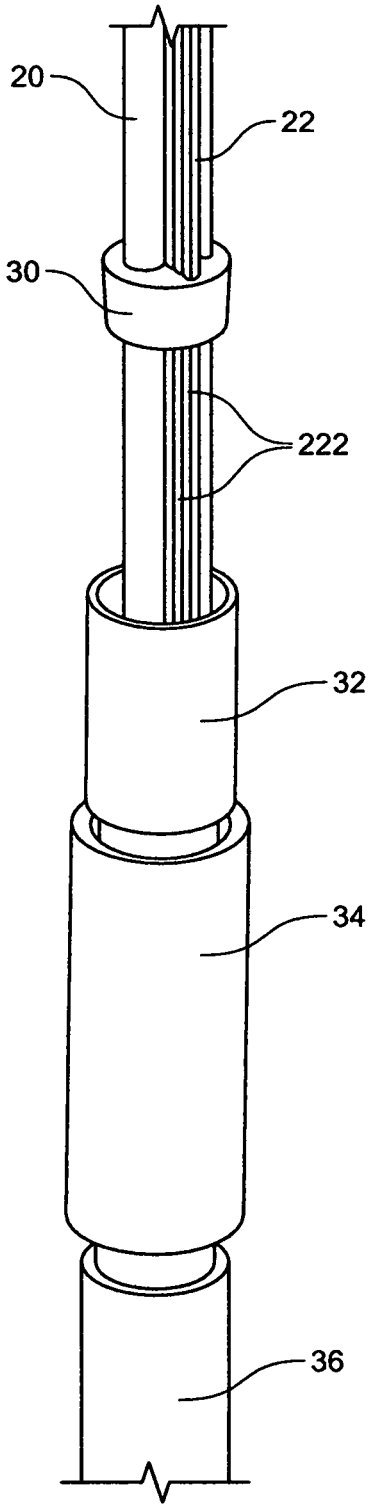

In FIG. 5, MI cables 20*a* and 20*b* are opened like a "V" until the rubber seal 30 is between them. Through holes 302 on the seal 30 is prepared for the MI cables. In an example, each MI cable might be provided with one through hole. It can also be seen that clamps or bands 222 might be used to tie up those instrument strings 22 below the seal 30. MI cables 20*a* and 20*b* might then be put through the through holes on the seal 30, as illustrated in FIG. 6. While inserting the MI cables and the instrument strings care must be taken to avoid damaging the rubber seal 30. After the installation, it will become clearer that the seal 30 will be able to prevent formation fluids from entering the coiled tubing 54 downstream this assembly. In some embodiments of the present invention, the seal 30, and the assembly 3 may secure the MI cables 20*a* and 20*b*, and the signal carrier 552 so that they are held in place and not movable upward or downward.

Figure 7:
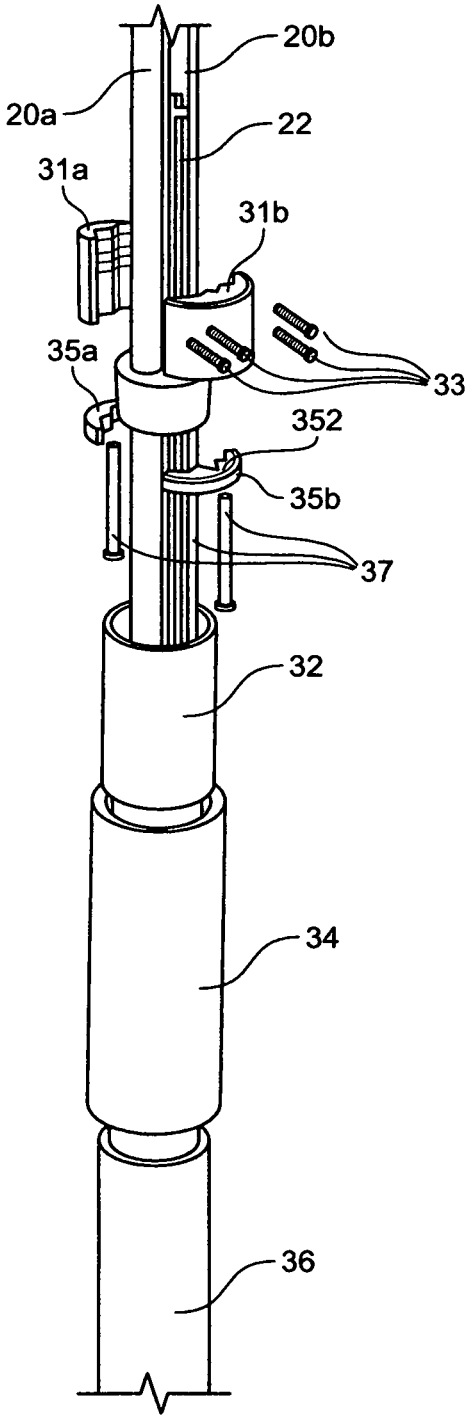
Figure 8:
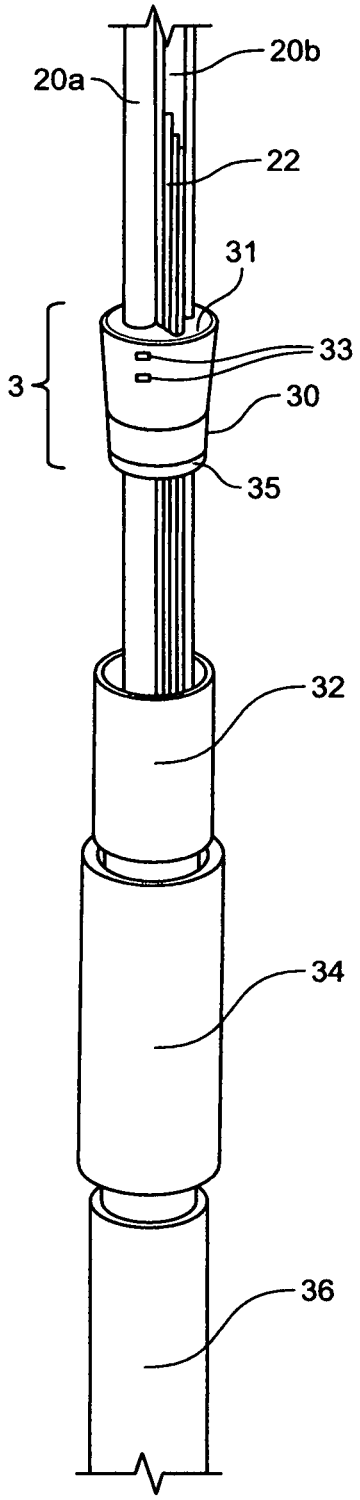

In FIG. 7, a split hanger 31 is used, which has a first part 31*a* and a second part 31*b*, connectable to each other via e.g. allen screws 33. An inner side of hanger 31 is designed for the purpose of restricting the movement of the MI cables 20*a* and 20*b* due to thermal expansion and/or contraction. An inner side of the hanger 31 may be also provided with grooves for the instrument strings 22. The hanger 31 is designed to be installed above the seal 30. An end cap 35 having a first part 35*a* and a second part 35*b* is also provided, to be installed below the seal 30. A recess on the end cap (for receiving the MI cables), 352, is shown on the end cap 35. A set of allen screws 37 are provided to fasten and fix the end cap 35 to the split hanger 31 via the rubber seal 30. An inner side of the end cap 35 may have grooves to adaptively receive the MI cables and instrument strings. After installation described with reference to FIGS. 4-7, an assembly 3 as illustrated in FIG. 8 can be obtained, including the split hanger 31, the rubber seal 30 and the end cap 35, serially connected. Those skilled in the art would appreciate that after at least partially placing the assembly 3 inside the lower connector 32, formation fluid will not be able to flow downward to the coiled tubing 54, as further illustrated in FIG. 9.

Figure 9:
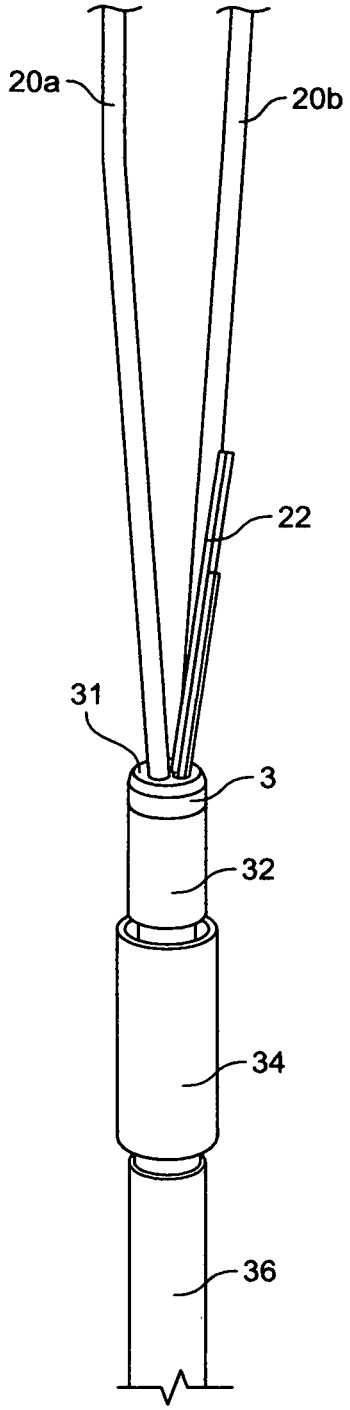

In FIG. 9, MI cables 20*a* and 20*b* are separated to form a "V" shape, to allow an upper connector enter and fit.

Figure 10:
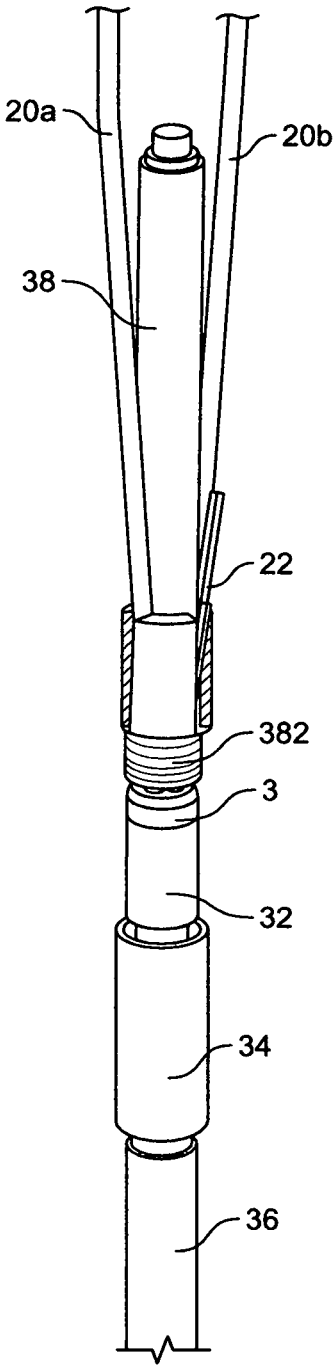
Figure 11:
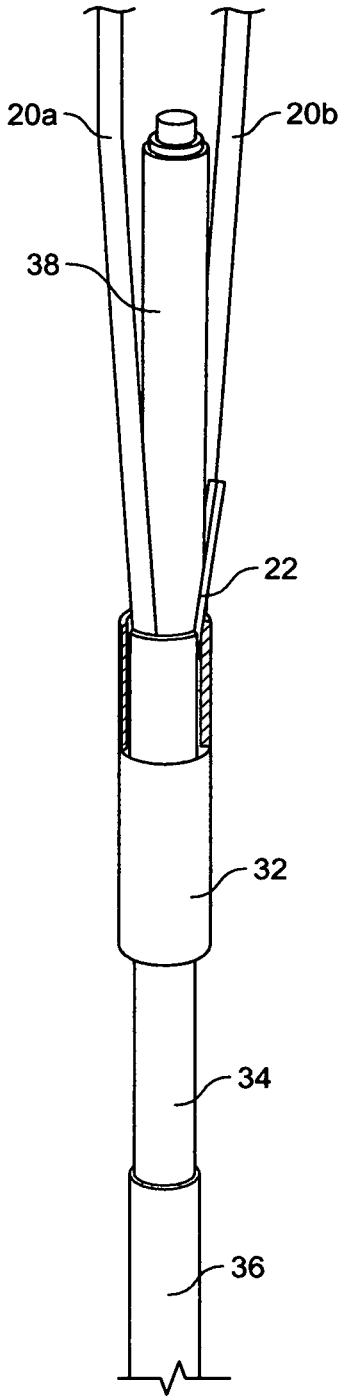

In FIG. 10, the upper connector 38 is provided, and an upper connector lower end 382 has screw thread connectable with the adjusting nut 34. The upper connector 38 is let down until it touches the top of the split hanger 31. The screw thread might have interruptions to allow the MI cables 20*a*, 20*b* and the instrument strings 22 to get out. In FIG. 11, the adjusting nut 34 is moved up to engage with, for example, but screw threads, with the upper connector 38. After then, the assembly is securely installed to the system. Referring to FIG. 3, the fixing nut 34 can have a flange 342 extruding radially inward, and the lower connector can have a flange 322 extruding radially outward, thereby fix the whole set. The lower part of the upper connector 38 also may provide an exit suitable for providing a means for the cable assembly to leave or exit the lower part of the upper connector. The figures show two power leads extending to two mineral insulated heater cables, but it is to be understood that the apparatus could be easily modified to utilize three power supply cables and three mineral insulated heaters to utilize a three phase power supply, or more power leads, for example, to power multiple one, two or three phase heaters located below the assembly.

Figure 12A:
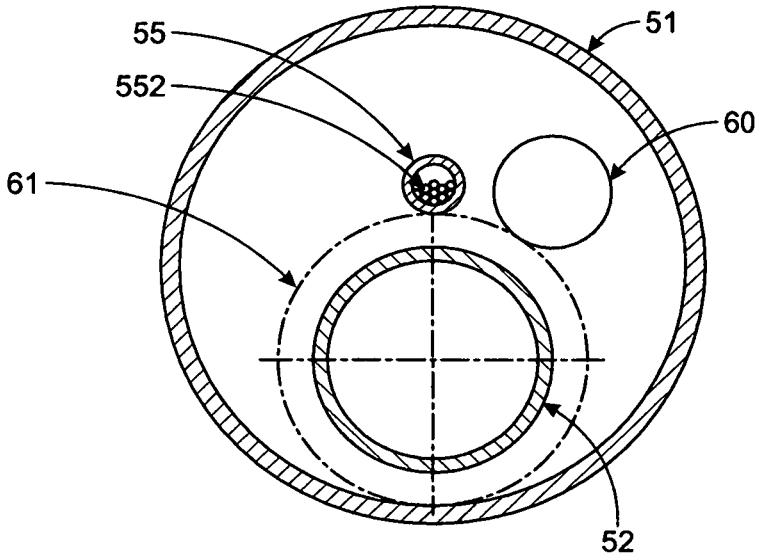
FIGS. 12*a*-12*g* illustrate section views of the wellbore instrumentation in FIGS. 1-2 marked A-A through G-G respectively.
Figure 12B:
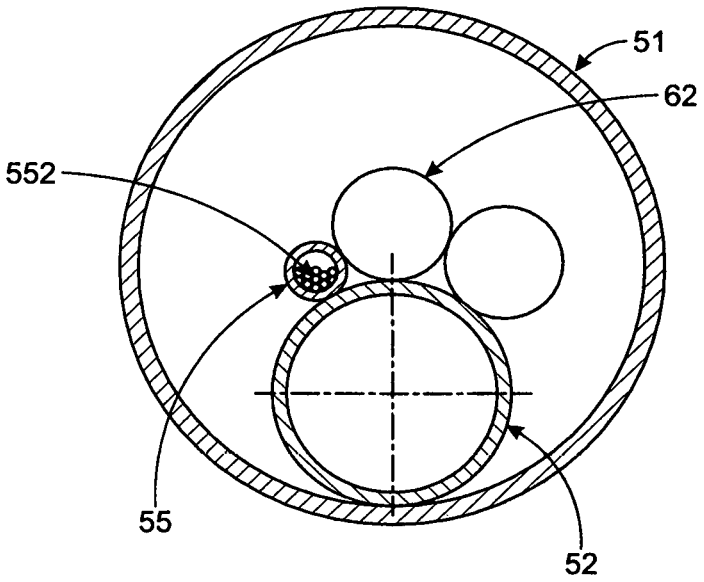
Figure 12C:
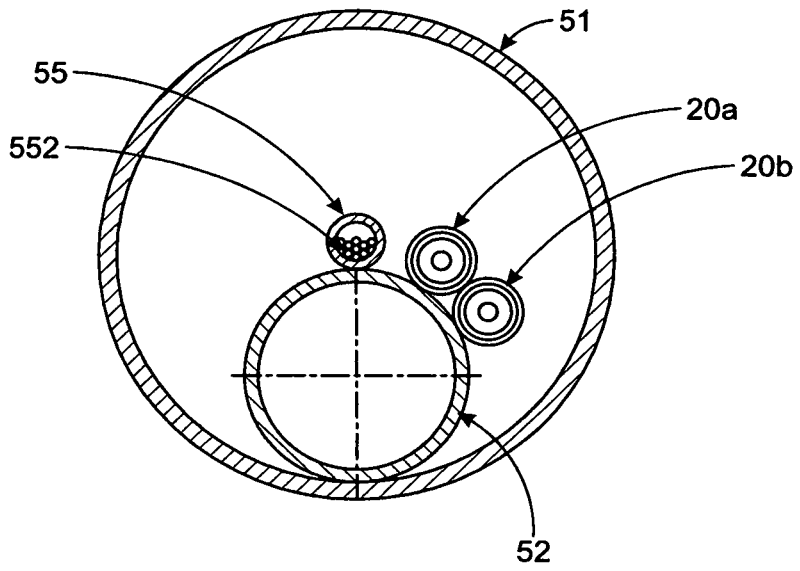
Figure 12D:
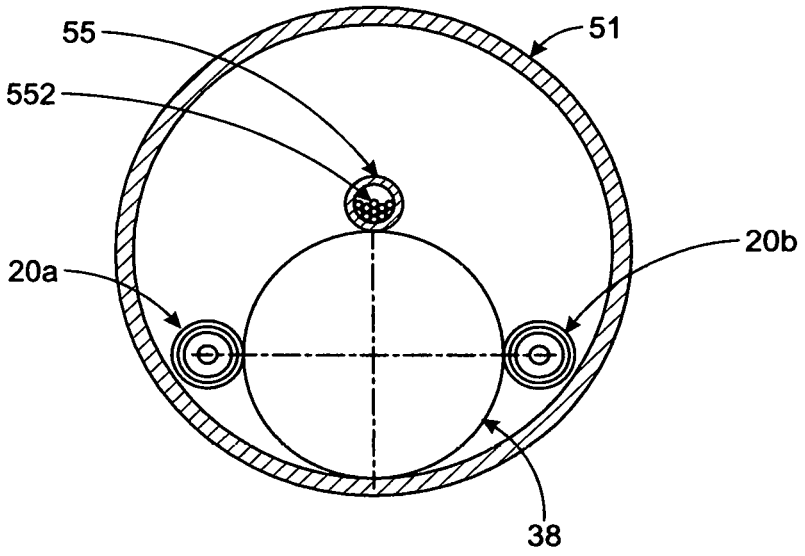
Figure 12E:
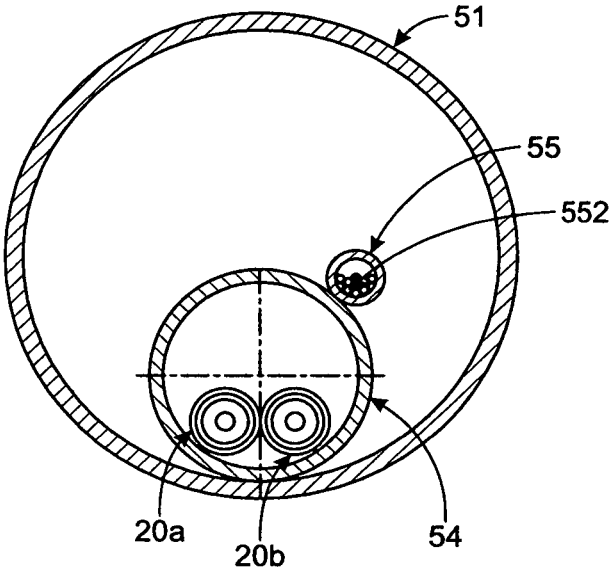

FIGS. 12*a*-12*g* illustrate section views of the wellbore instrumentation in FIGS. 1-2, with elements labeled as in FIGS. 1-2. Referring to FIGS. 12*c*-*e*, the transition from coiled tubing 54 to production tubing 52 can be seen.

FIG. 12*a* shows a cross section of a production tubing section. The production tubing 52 is inside the casing 51. A power lead-in 60 is also inside the casing and a tube 55, containing fiber optic cables, or other instrumentation (such as, for example, thermocouples) and/or control signal carriers, such as fiber optic cables, 552. A coupling, or connector, 61 can be seen which could connect, for example, power lead-ins 60 to power leads for individual mineral insulated heater cables, 20*a* and 20*b*.

FIG. 12*b* shows a cross section where the power cables, 60, are being spliced to the MI cables by power lead splices 62 (two shown). MI heater cables may be connected to power lead-ins by any subsea power connectors, for example, Seimens SpecTRON MUTU modular umbilical termination units. One end of the modular termination unit may be connected to a MI cable, for example, by a crimp and pot method, and the other end of the modular by known methods. Connections to metal sheathed mineral insulated heater cables may need to be modified compared to other applications of modular umbilical termination applications that connect to polymer coated power cables by, for example, extension of the length of the potting material to accommodate sufficient seal to metal sheathing, treatment of the exterior of the metal sheathing to improve adhesion between the potting material and the metal sheath, or incorporation of potting material with polar functionality to improve adhesion between the potting material and the metal sheath of the mineral insulated cable. A ribbed sleeve could also be provided around the mineral insulated cable, for example, crimped or welded to the sheath of the mineral insulated cable to increase the surface area for adherence between the sheath and the potting material.

FIG. 12*c* shows a cross section of the casing, 51, where the production tubing is in the casing with MI cables 20*a* and 20*b*, and the tube 55.

FIG. 12*d* shows a cross section of the casing at the upper connector 38 with the MI cables 20*a* and 20*b* still outside of the connector.

FIG. 12*e* shows a cross section of the casing where the MI cables are within the coiled tubing 54.

Figure 12F:
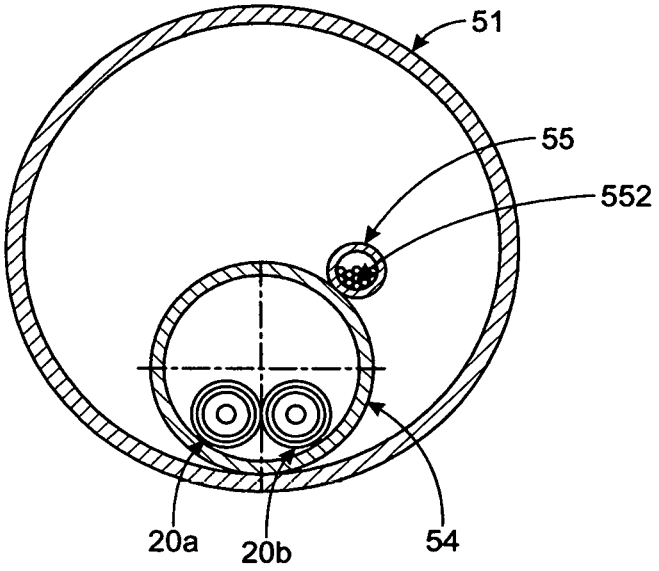

FIG. 12*f* shows a cross section of the casing in the heating section of a wellbore where the apparatus of the present invention is used to connect well heaters to a production tubing.

Figure 12G:
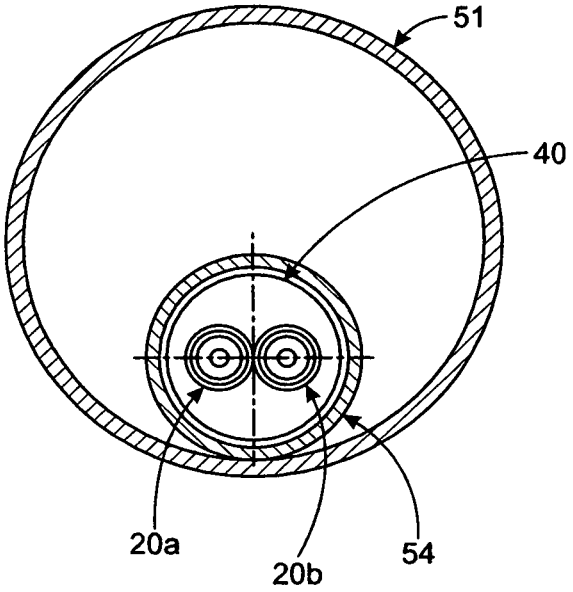

FIG. 12*g* shows a cross section of the just before the end termination of the coiled tubing, 40.

In an embodiment of the invention, MI downhole hanger assembly designed to support MI cables and an equipment string, for example, an instrument string, above a coiled tubing string. The hanger assembly is attached to a coiled tubing connector, for example, by threads, after the coiled tubing is deployed downhole. The assembly provides a seal connectable to the split hanger, configured to prevent formation fluid from entering the coiled tubing. FIGS. 3 and 4, for example, show a seal for each of the MI cables and instrument strings effective to prevent any wellbore fluids from entering the coiled tubing assembly. In addition, this assembly provides means for the transition of the MI cables and instrument strings installed inside the coiled tubing string from the interior to the exterior of the MI downhole hanger assembly. This allows for the MI cables and instrument strings to be strapped onto the exterior of the production tubing for the remaining distance from the downhole location to the wellhead at the surface. Additionally, the MI downhole hanger assembly provides for the necessary crossover from the coiled tubing assembly to the production tubing and allows the coiled tubing assembly to be attached to the production string below the intake of the production pump.

The present disclosure is not limited to the embodiments as described above and the appended claims. Many modifications are conceivable and features of respective embodiments may be combined. The following examples of certain aspects of some embodiments are given to facilitate a better understanding of the present invention. In no way should these examples be read to limit, or define, the scope of the invention.

It is to be understood the invention is not limited to particular systems described which may, of course, vary. It is also to be understood that the terminology used herein is for the purpose of describing particular embodiments only, and is not intended to be limiting. As used in this specification, the singular forms "a", "an" and "the" include plural referents unless the content clearly indicates otherwise. Thus, for example, reference to "a core" includes a combination of two or more cores and reference to "a material" includes mixtures of materials.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

We claim:

1. An assembly for downhole deployment of well equipment, the assembly being above a coiled tubing which receives a part of a cable assembly and below a production tubing, the assembly comprising:

a split hanger fixing the cable assembly outside the coiled tubing;

a seal connectable to the split hanger, configured to prevent formation fluid from entering the coiled tubing; and a set of connectors, configured to connect the assembly to the coiled tubing, the set of connectors comprising:

a coiled tubing connector, configured to connect the assembly to the coiled tubing;

a lower connector, an upper part of the lower connector being adapted to receive, at least in part, the split hanger and the seal;

an upper connector arranged above the lower connector;

an adjusting nut, the upper connector and the adjusting nut being connectable to each other, thereby fixing the assembly relative to the coiled tubing; and a lower part of the upper connector having an exit enabling the cable assembly to extend out of the assembly.

2. The assembly according to claim 1, wherein the adjusting nut has a flange extruding radially inward and the lower connector has a flange extruding radially outward.

3. The assembly according to claim 1, further comprising a end cap, which is connectable to the split hanger via the seal.

4. The assembly according to claim 1 wherein the wellbore equipment comprises at least one mineral insulated heater.

5. The assembly according to claim 1 wherein the wellbore equipment comprises at least one electrical submersible pump.

6. The assembly according to claim 5 comprising mineral insulated heaters located in the coiled tubing and an electrical submersible pump located in the production tubing.

7. The assembly according to claim 1 wherein the wellbore equipment comprises thermocouples.

8. A method for downhole deployment of well equipment, comprising:

providing an assembly being above a coiled tubing which receives a part of a cable assembly and below a production tubing, the assembly comprising:

a split hanger fixing the cable assembly outside the coiled tubing;

a seal connectable to the split hanger, configured to prevent formation fluid from entering the coiled tubing;

a set of connectors, configured to connect the assembly to the coiled tubing, the set of connectors comprising:

a coiled tubing connector, configured to connect the assembly to the coiled tubing;

a lower connector, an upper part of the lower connector being adapted to receive, at least in part, the split hanger and the seal;

an upper connector arranged above the lower connector;

an adjusting nut, the upper connector and the adjusting nut being connectable to each other, thereby fixing the assembly relative to the coiled tubing;

a lower part of the upper connector having an exit enabling the cable assembly to extend out of the assembly.

9. The method according to claim 8, wherein the adjusting nut has a flange extruding radially inward and the lower connector has a flange extruding radially outward.

10. The method according to claim 8, wherein the assembly further comprising an end cap, which is connectable to the split hanger via the seal.

* * * * *